US012628882B2

(12) United States Patent
Wilson, II

(10) Patent No.: US 12,628,882 B2
(45) Date of Patent: May 19, 2026

(54) LOWER-BODY GARMENT HAVING SLING ASSEMBLY

(71) Applicant: Sinlow Norlad, Inc., Bonita Springs, FL (US)

(72) Inventor: Ronald L. Wilson, II, Bonita Springs, FL (US)

(73) Assignee: Sinlow Norlad, Inc., Bonita Springs, FL (US)

( * ) Notice: Subject to any disclaimer, the term of this patent is extended or adjusted under 35 U.S.C. 154(b) by 0 days.

(21) Appl. No.: 18/097,595

(22) Filed: Jan. 17, 2023

(65) Prior Publication Data

US 2025/0160445 A1 May 22, 2025

Related U.S. Application Data

(60) Provisional application No. 63/303,195, filed on Jan. 26, 2022.

(51) Int. Cl.

| | |
|---|---|
| ***A41B 9/12*** | (2006.01) |
| ***A41B 9/02*** | (2006.01) |
| ***A41B 9/14*** | (2006.01) |
| ***A41B 17/00*** | (2006.01) |

(52) U.S. Cl.

CPC ..... *A41B 9/12* (2013.01); *A41B 9/02* (2013.01); *A41B 9/14* (2013.01); *A41B 17/005* (2013.01); *A41B 2400/60* (2013.01)

(58) Field of Classification Search

CPC ..... A41B 9/12; A41B 9/02; A41B 9/14
USPC ..... 602/67–71, 73
See application file for complete search history.

(56) References Cited

U.S. PATENT DOCUMENTS

| | | | | |
|---|---|---|---|---|
| 1,483,351 | A * | 2/1924 | Keirstead | A61F 5/40 602/70 |
| 6,820,284 | B2 * | 11/2004 | Horikoshi | A41B 9/023 2/403 |
| 8,808,216 | B2 * | 8/2014 | Diamond | A61F 5/40 2/403 |
| 9,393,151 | B2 * | 7/2016 | Gallen | A61F 7/02 |
| 9,452,100 | B2 * | 9/2016 | Bigelow | A41C 1/08 |
| 9,717,281 | B2 * | 8/2017 | Mehrabian | A61F 13/56 |
| 2024/0292908 | A1 * | 9/2024 | Perez | A41B 9/02 |

* cited by examiner

*Primary Examiner* — Gloria M Hale
(74) *Attorney, Agent, or Firm* — Harold H. Fullmer

(57) ABSTRACT

A lower body garment is disclosed having a sling assembly for securing male genitalia. The sling assembly is configured with limited, prescribed attachment points, which enables increased comfort and support, for the wearer. Moreover, the sling assembly provides a comfortable encapsulation that reduces the jostling of the testicles during athletic endeavors. The sling assembly configuration can further provide moisture management to reduce itching, chafing, and infection.

15 Claims, 13 Drawing Sheets

LOWER-BODY GARMENT HAVING SLING ASSEMBLY

CROSS REFERENCE TO RELATED APPLICATION

Application

This application claims the benefit of U.S. App. No. 63/303,195, filed Jan. 26, 2022, which is incorporated by reference.

FIELD OF THE INVENTION

The present invention generally relates to garments for the lower body and, more particularly, such garments having a sling assembly for secure support of male genitalia.

BACKGROUND OF THE INVENTION

There are several common types of underwear for men's design, including briefs, boxers, and boxer briefs. Whereas boxers typically include longer leg portions and a loose fit. Boxer briefs are a hybrid of boxers and briefs, with longer legs like boxers and a snug fit like briefs. These designs have benefits; however, shortfalls exist.

For example, moisture builds in the groin area during strenuous exercise, work, or sleeping. Current designs are generally ineffective in addressing moisture buildup, keeping moisture proximate to the skin, leading to itching, chafing, bacterial infections, and fungal infections. Moreover, current designs tend to provide ineffective support to the wearer's genitalia, which can cause discomfort and increase the risk of injury, particularly during exercise or strenuous work conditions.

It should, therefore, be appreciated that there exists a need for a lower-body garment that addresses these shortfalls and others.

SUMMARY OF THE INVENTION

Briefly, and in general terms, the invention provides a lower-body garment having a sling assembly to secure male genitalia. The sling assembly is configured with limited, prescribed attachment points, which enables increased comfort and support, for the wearer. Moreover, the sling assembly provides a comfortable encapsulation that reduces the jostling of the testicles during athletic endeavors. The sling assembly configuration can further provide moisture management to reduce itching, chafing, and infection.

More specifically, in an exemplary embodiment, the lower-body garment includes a waistband configured to be disposed about the waist of the wearer, having a front portion, and a garment body configured to be disposed about the trunk of the wearer, the garment body having an upper portion attached to the waistband assembly, a lower portion defining two openings for the legs of the wearer, and a groin region disposed between the two openings. The garment further includes a sling assembly having a cupped portion sized and positioned to cup male genitalia, when worn. The cupped portion having a lower end and an upper end. The upper end is attached to the front portion of the waistband assembly and/or the upper portion of the garment body. The sling assembly further having a connector assembly having a first section and a second section spaced therefrom. The first section attached to the lower end of the cupped portion and the second section attached to the garment body such that the connector assembly extends into a groin region of the garment body. As a result, the sling assembly has limited attachment points, namely, the upper end of the cupped portion attached the waistband and the connector attached to the garment body.

In a detailed aspect of an exemplary embodiment, the connector assembly includes a two connector straps. The first connector strap has two connections, namely, a first connection attached to the lower end of the cupped portion, and a second connection attached to back portion of the garment body. The second connector strap also has two connections, namely, a first connection attached to the lower end of the cupped portion, and a second connection attached to back portion of the garment body.

In another detailed aspect of an exemplary embodiment, the sling assembly is free of attachments to the groin region.

In another detailed aspect of an exemplary embodiment, the connector assembly includes adjustable connector straps attaching the cupped portion to the rear portion of the garment, in which the connector straps extend through apertures defined by the rear portion of the garment body, to enable the wearer to adjust the straps.

In another detailed aspect of an exemplary embodiment, the garment body is formed of multiple fabric panels, including a back panel in a back portion of the garment body, a right-side panel, a left-side panel, a front panel, and a gusset panel in the groin region of the garment body.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particularly preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
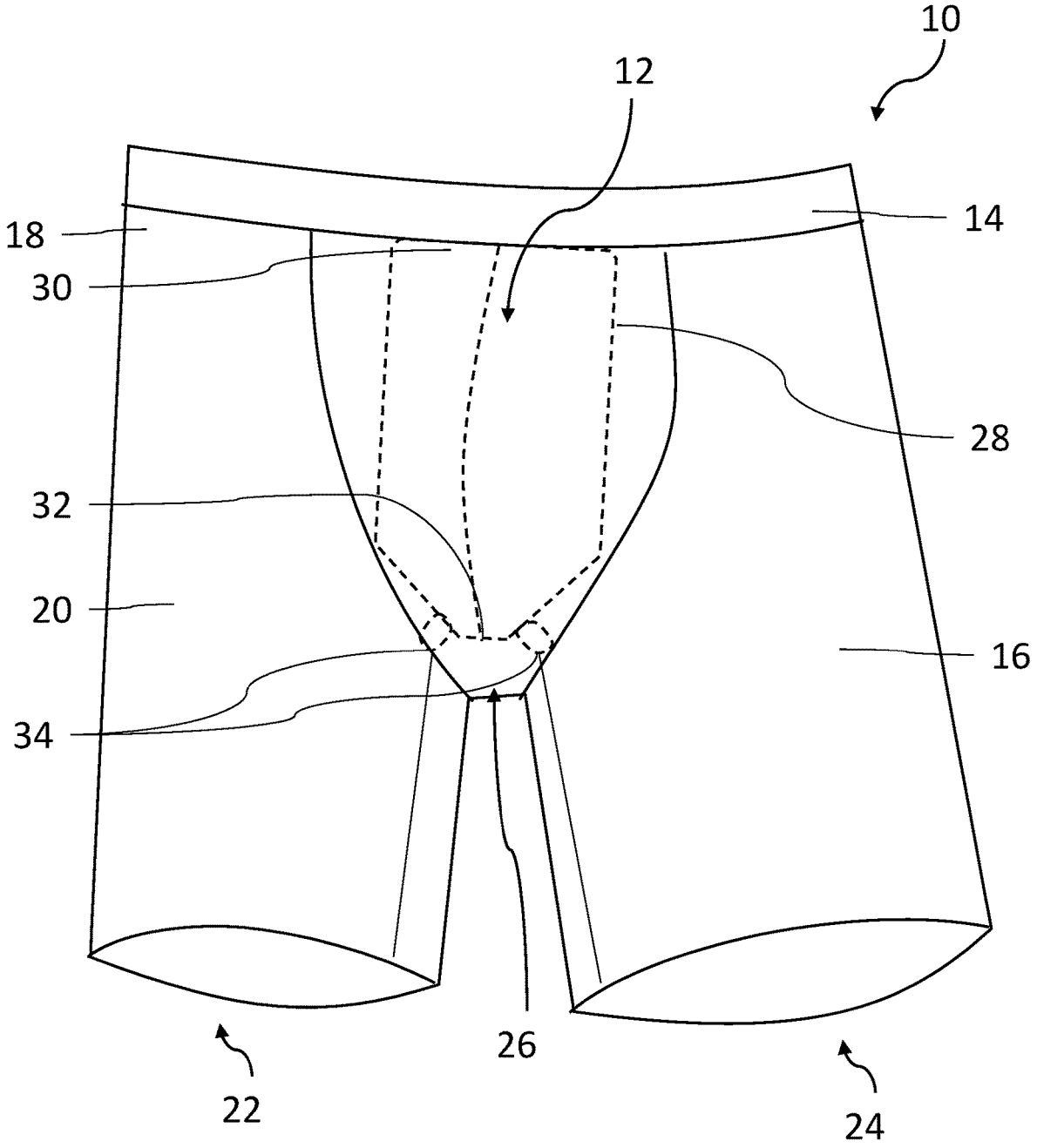
FIG. 1 is a front view of a lower-body garment in accordance with the invention, showing a sling assembly, which is disposed of in the interior of the garment, in phantom.

Referring now to the drawings, and particularly FIG. 1, there is shown a lower-body garment 10 having a sling assembly 12 to secure male genitalia. The sling assembly is configured with limited, prescribed attachment points, which enables increased comfort and support, for the wearer. Moreover, the sling assembly provides a comfortable encapsulation that reduces the jostling of the testicles during athletic or high-intensity work endeavors. The sling assembly configuration can further provide moisture management to reduce itching, chafing, and infection.

Figure 2:
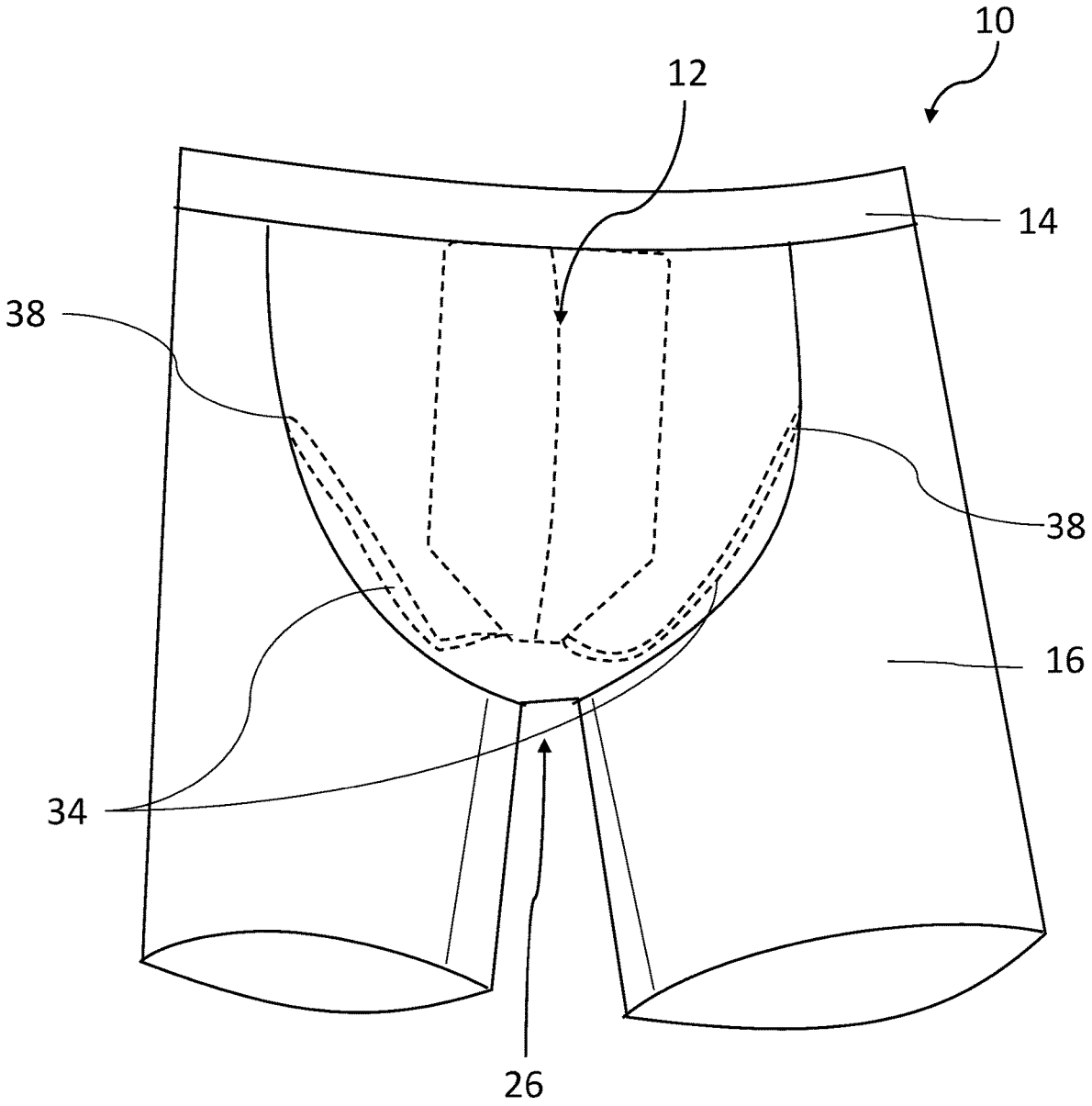
FIG. 2 is a back view of the garment of FIG. 1, showing the first and second connector straps of the sling assembly, which are disposed of in the interior of the garment, in phantom.

With reference to FIGS. 1 and 2, the lower-body garment 10 includes a waistband 14 configured to be disposed about the waist of the wearer, having a front portion, and a garment body 16 configured to be disposed about the trunk of the wearer, the garment body 16 having an upper portion 18 attached to the waistband assembly 14, a lower portion 20 defining two openings 22, 24 for the legs of the wearer, and a groin region 26 disposed between the two openings. The garment further includes a sling assembly 12 having a cupped portion 28 sized and positioned to support male genitalia, when worn. The cupped portion having an upper end 30 and a lower end 32. The upper end is attached to the front portion of the waistband assembly and/or the upper portion of the garment body. The sling assembly further having a connector assembly 34 having a first section 36 and a second section 38 spaced therefrom. The first section is attached to the lower end of the cupped portion, and the second section is attached to the garment body such that the connector assembly extends into and through the groin region 26 of the garment body 16. As a result, the sling assembly 12 has limited attachment points; namely, the upper end of the cupped portion attached to the waistband and the connector(s) attached to the garment body.

Figure 3:
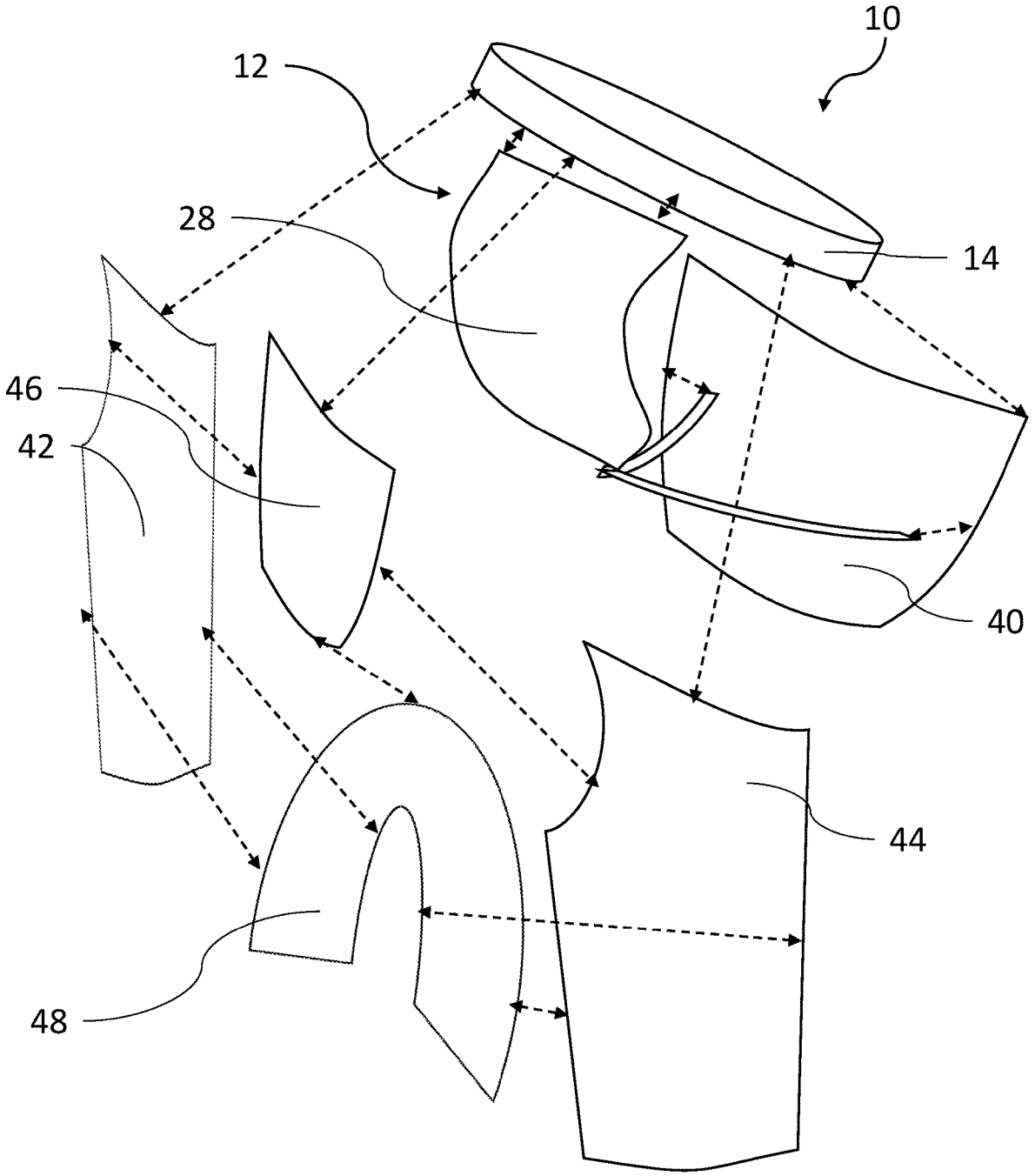
FIG. 3 is an exploded view of the garment of FIG. 1.

With reference now to FIG. 3, in the exemplary embodiment, the garment body 16 is formed of multiple fabric panels, including a back panel 40 in a back portion of the garment body, a right-side panel 42, a left-side panel 44, a front panel 46, and a gusset panel 48 in the groin region of the garment body. The back panel is attached to the waistband 14 along an upper edge, attached to the right-side panel along a right-side edge, attached to the left-side panel along a left-side edge, and attached to the gusset along a bottom edge. As best seen in FIG. 2, the end sections 38 of the connector straps 34 are secured via the attachment seams for the back panel (40) and the right- and left-side panels (42, 44), respectively.

The front panel 46 is attached to the waistband 14 along an upper edge, attached to the right-side panel 42 along a right-side edge, attached to the left-side panel 44 along a left-side edge, and attached to the gusset 48 along a bottom edge. As best seen in FIG. 1, the upper end 30 of the cupped section of the sling assembly 12, is secured via the attachment seam for the front panel (46) and the waistband 14.

The gusset 48 is attached to the front panel 40 along an upper edge, attached to the right-side panel 42 along a right-side edge, attached to the left-side panel 44 along a left-side edge, and attached to the gusset 48 along a bottom edge. As best seen in FIG. 1, the upper end 30 of the cupped section of the sling assembly 12, is secured via the attachment seam for the front panel (46) and the waistband 14.

In the exemplary embodiment, the cupped portion 28 comprises two mirror-image fabric panels butted together and sewn along one side. The outer edge of the combined sections is bound on their opposite outer edges and the bottom. The top edge is left unbound and is sewn into the top of the front of the garment and/or the garment waistband. One end of the connector section of the sling is sewn into the bottom of the cup section, and the other end is sewn into the gusset and/or back panel of the garment.

In addition, the sling assembly 12, in an exemplary embodiment, is constructed utilizing moisture-wicking, low coefficient of friction fabric. Sweat and urine are wicked away from the skin and transported to the garment's outer fabric layer, reducing discomfort, itching, chafing, and infections. The sling assembly could be produced with one or more mesh panels to increase breathability. The sling section's cup portion could be produced with additional panels formed to create more cupping of the male genitalia. One or more additional panels could be added to increase the absorption of sweat and/or urine.

Figure 4:
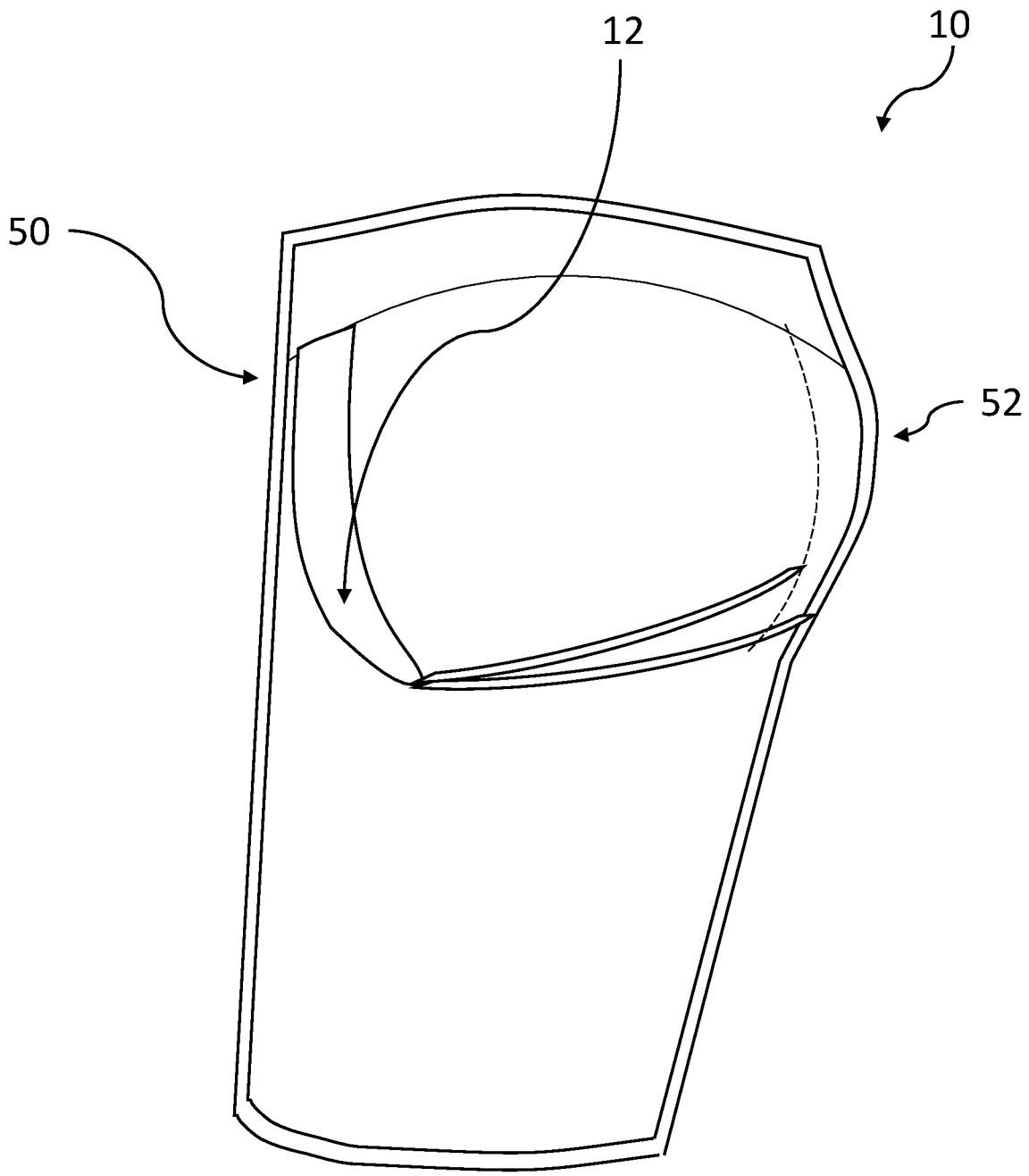
FIG. 4 is a cross-sectional view, of the garment of FIG. 1.
Figure 5:
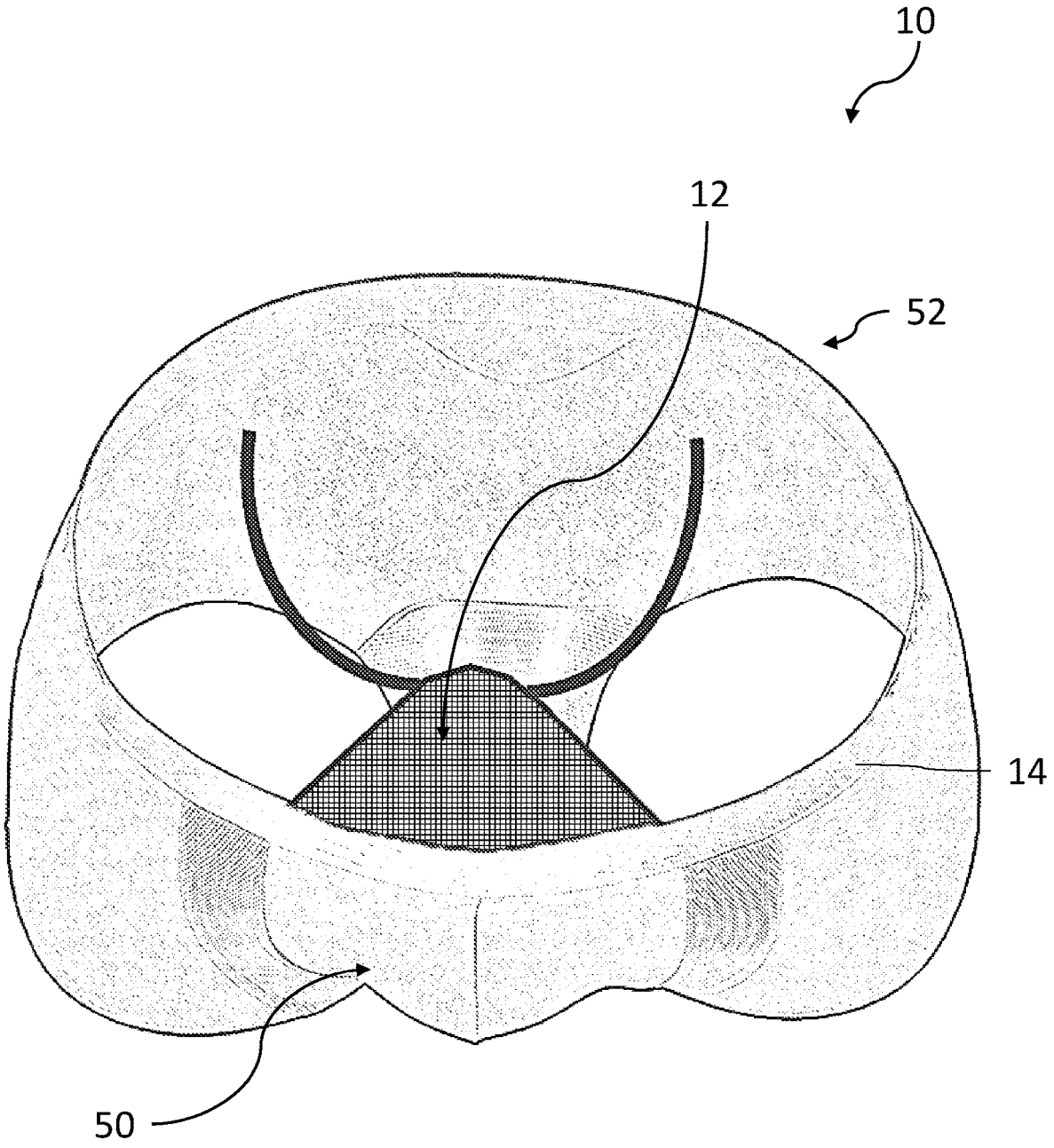
FIG. 5 is a top perspective view of the garment of FIG. 1, showing first and second connector straps of the sling assembly, attached to the rear portion of the garment body.

With reference to FIGS. 4 and 5, the sling assembly 12 is only attached to the front portion of the garment 10 and the rear portion of the garment, above the groin region, such that the sling assembly is freely suspended therebetween. Moreover, the sling assembly is free of attachments to the groin region of the garment 10. This configuration facilitates comfort and support, among other things.

Figure 6:
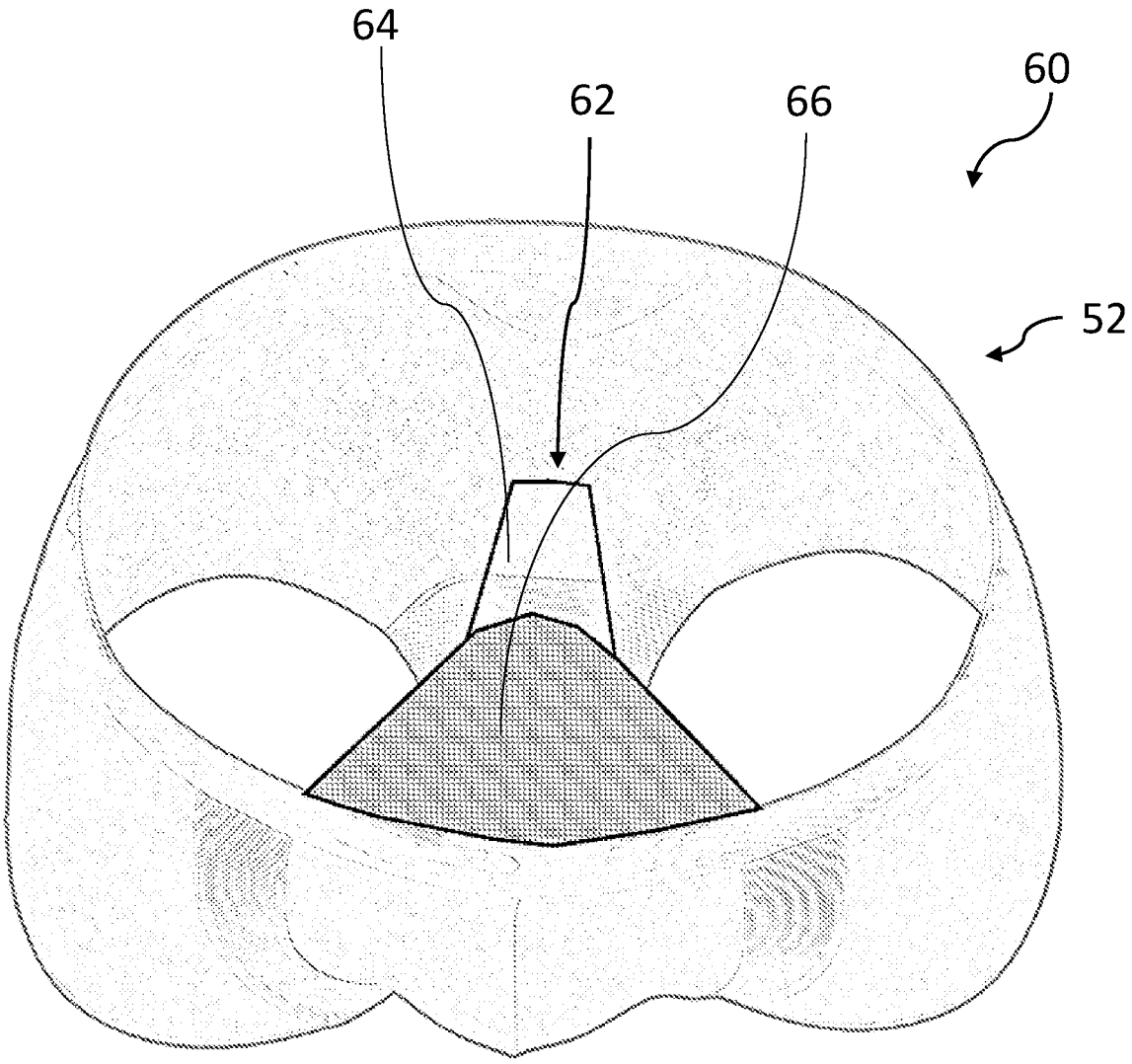
FIG. 6 is a top perspective view of another embodiment of a lower-body garment in accordance with the invention, showing a connector assembly having a single strap attaching the cupped portion to the rear portion of the garment body.

With reference now to FIG. 6, in another exemplary embodiment, a lower-body garment 60 includes a sling assembly 62 having a connector assembly 64 formed of a single strap attaching the cupped portion 66 to the rear portion 52 of the garment body.

Figure 7:
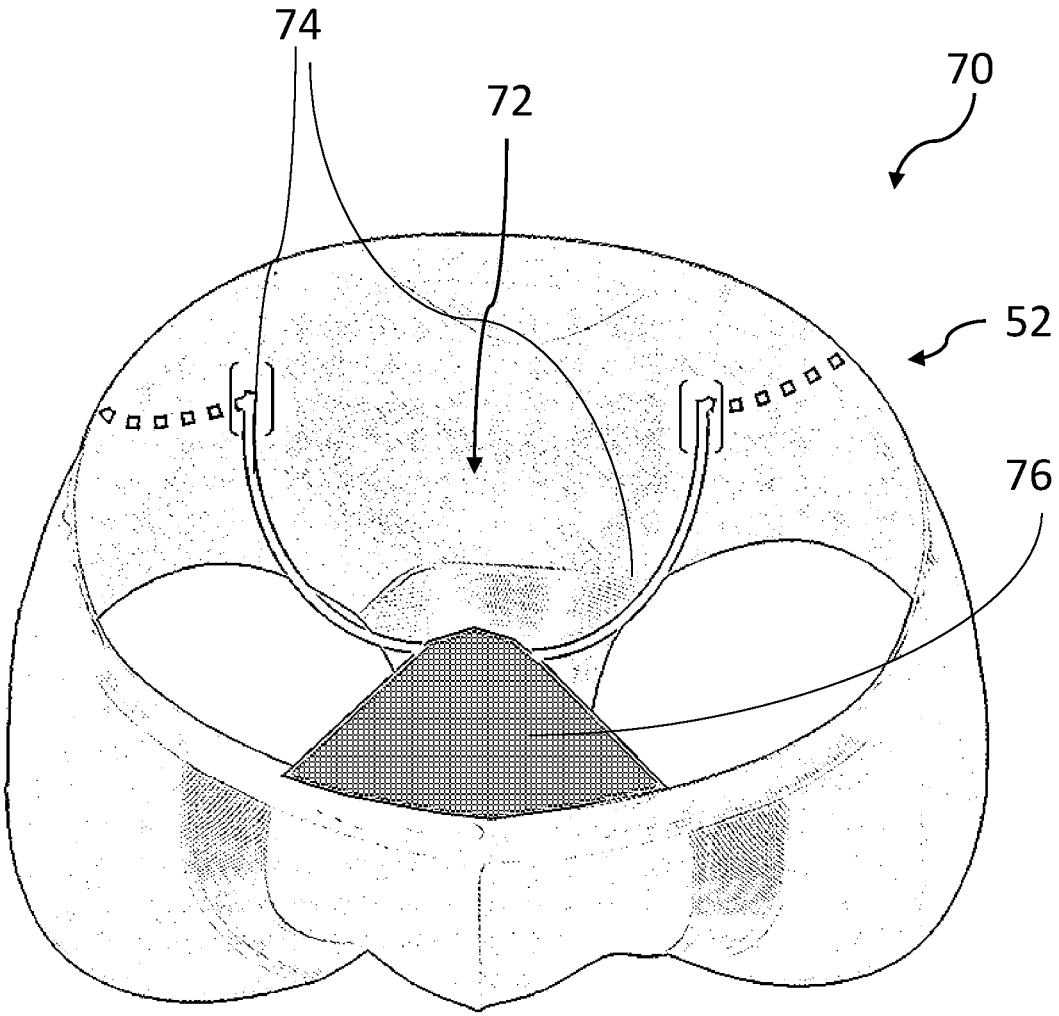
FIG. 7 is a top perspective view of another embodiment of a lower-body garment in accordance with the invention, showing adjustable connector straps of a sling assembly, attaching the cupped portion to the rear portion of the garment body.

With reference now to FIG. 7, in another exemplary embodiment, a lower-body garment 70 includes a sling assembly 72 having a connector assembly 74 formed of adjustable connector straps attaching the cupped portion 76 to the rear portion 52 of the garment 70. The connector straps extend through apertures defined by the rear portion 52, to enable the wearer to adjust the straps. The straps can be adjusted and secured by incorporating hook and loop connectors, snaps, buttons, or by tying the posterior connector straps with short complementary tie strings attached at either side of the garment's waistband or upon either side of the garment body.

Figure 8:
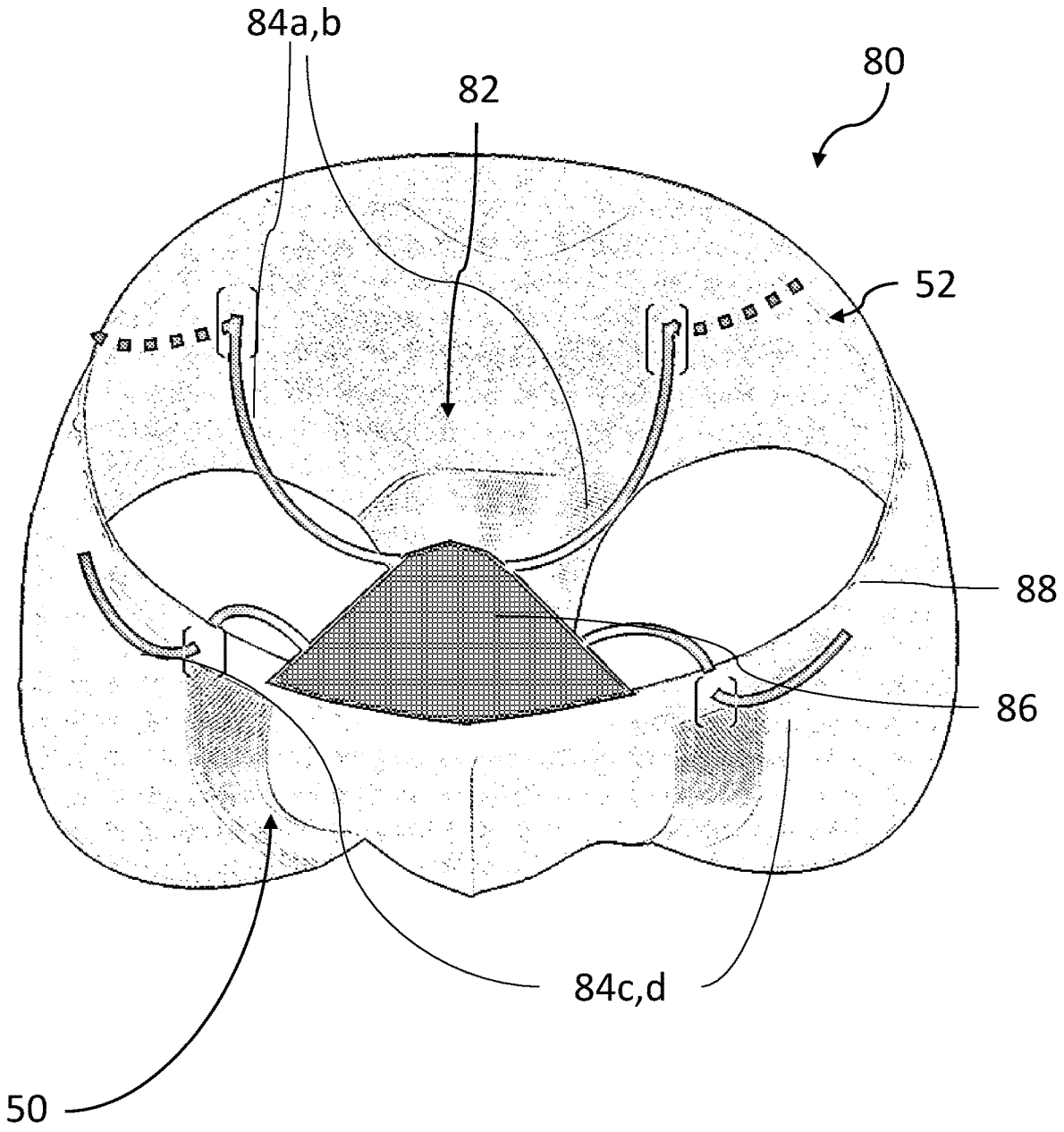
FIG. 8 is a top perspective view of another embodiment of a lower-body garment, similar to FIG. 7, further having a pair of forward adjustable connector straps extending from an intermediate region of the cupped portion, attaching the cupped portion to the front portion of the garment body.

With reference to FIG. 8, in another exemplary embodiment, a lower-body garment 80 includes a sling assembly 82 (similar to that of FIG. 7), having a connector assembly 84 formed of four adjustable connector straps (84*a-d*) attaching the cupped portion 86 to the rear portion 52 and the front portion 50 of the lower-body garment 80. The connector straps extend through apertures defined by the rear portion 52, or within the waistband 88, and the front portion 50, or within the waistband 88, to enable the wearer to adjust the straps. The straps can be adjusted and secured by incorporating hook and loop connectors, snaps, buttons, or by tying the anterior and posterior connector straps at the left and right sides of the garment waistband, respectively.

Figure 9:
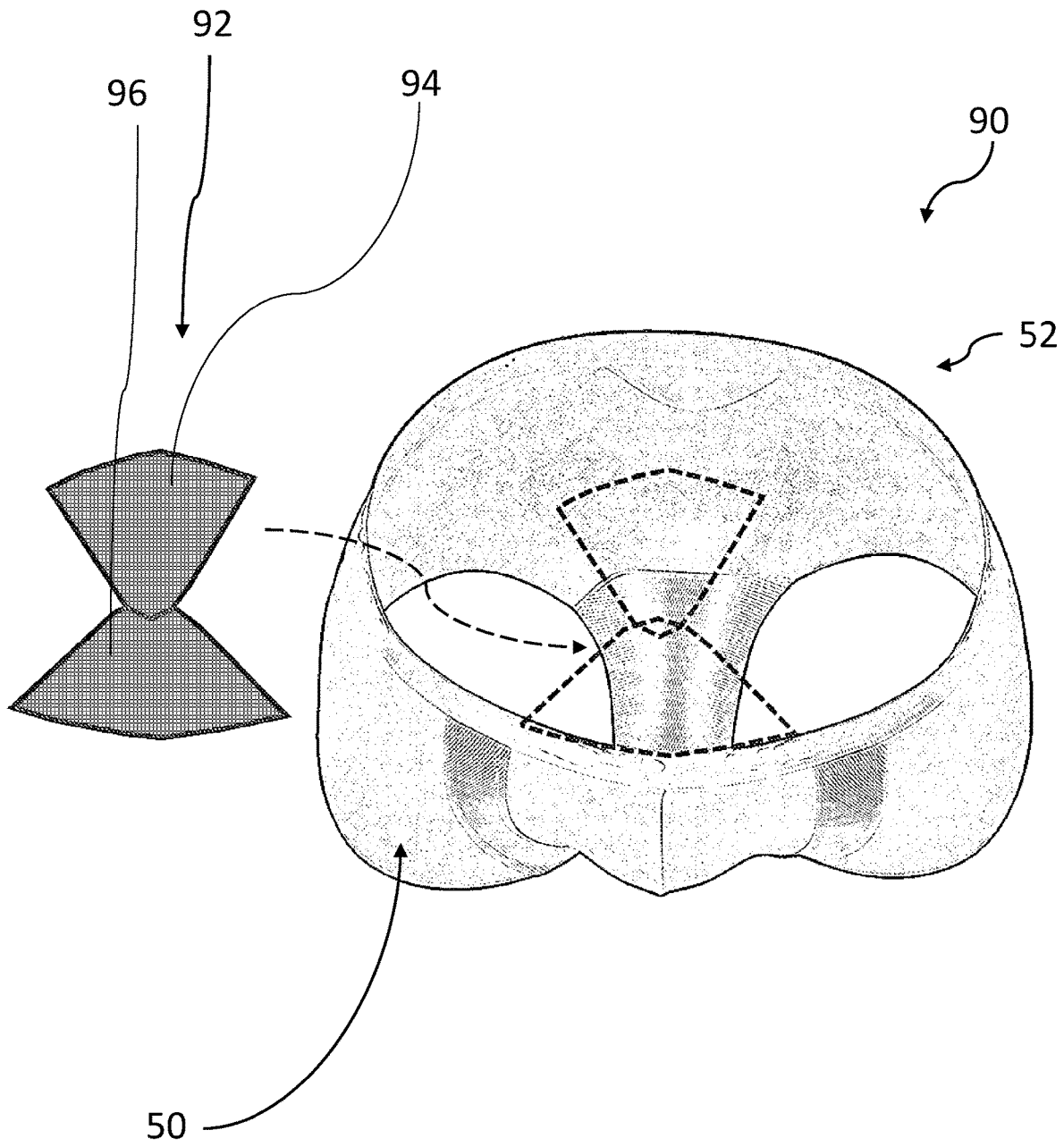
FIG. 9 is a top perspective view of another embodiment of a lower-body garment in accordance with the invention, showing a removable sling assembly having an hourglass shape.

With reference to FIG. 9, in another exemplary embodiment, a lower-body garment 90 includes a removable sling assembly 92, having an hourglass configuration. The sling assembly includes a cupped portion 96 and a connector assembly 94. The connector assembly is formed of a single connector assembly attached to the rear portion 52 of the garment body. The sling assembly is removably secured by incorporating hook and loop connectors, snaps, or buttons. The sling assembly is only attached to the front portion 50 of the garment 90 and the rear portion 52 of the garment, above the groin region, such that the sling assembly is freely suspended therebetween. Moreover, the sling assembly is free of attachments to the groin region. Alternatively, the sling assembly can be permanently attached.

Figure 10:
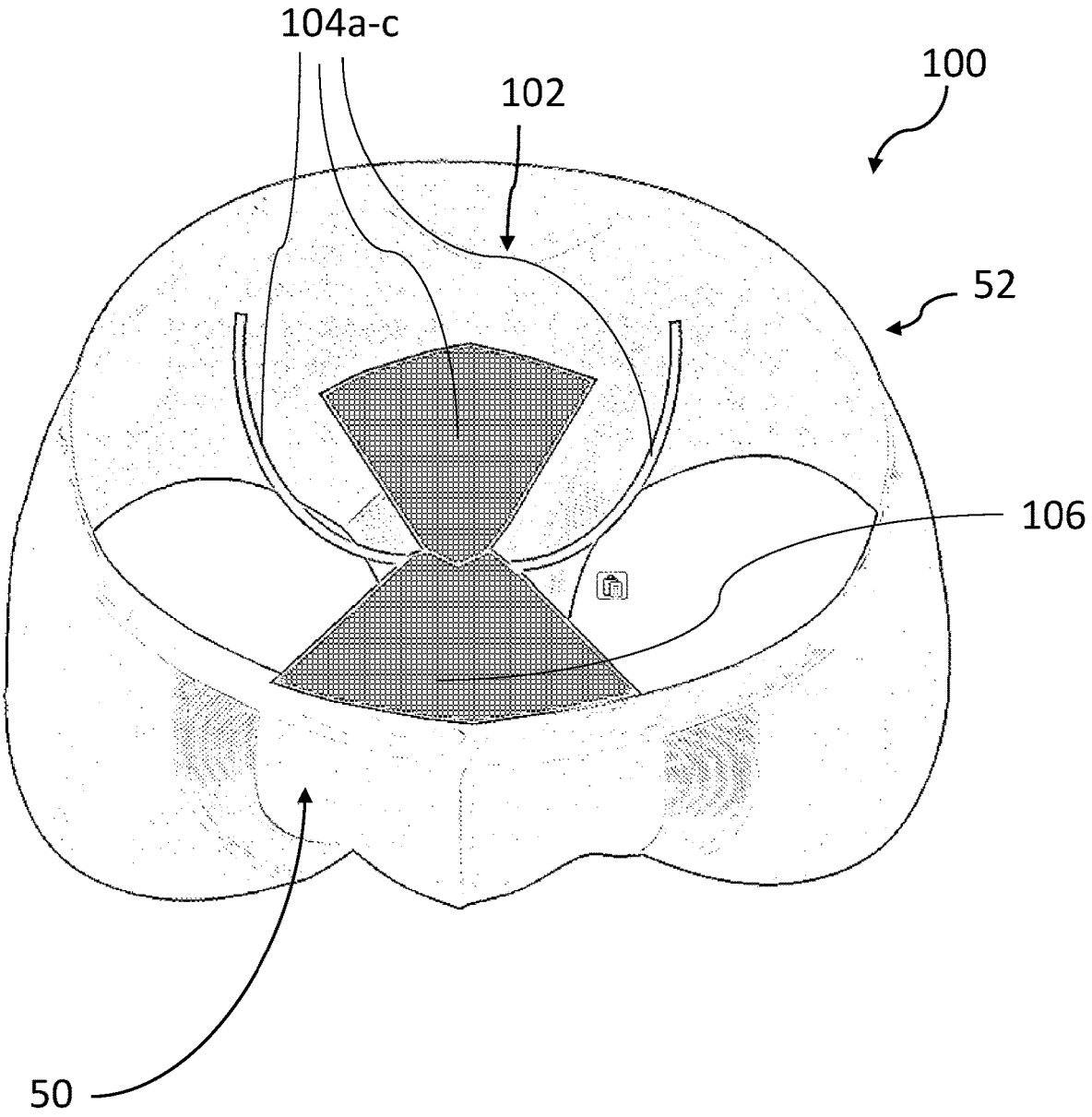
FIG. 10 is a top perspective view of another embodiment of a lower-body garment in accordance with the invention, showing a sling assembly having an hourglass shape, further having adjustable connector straps.
Figure 11:
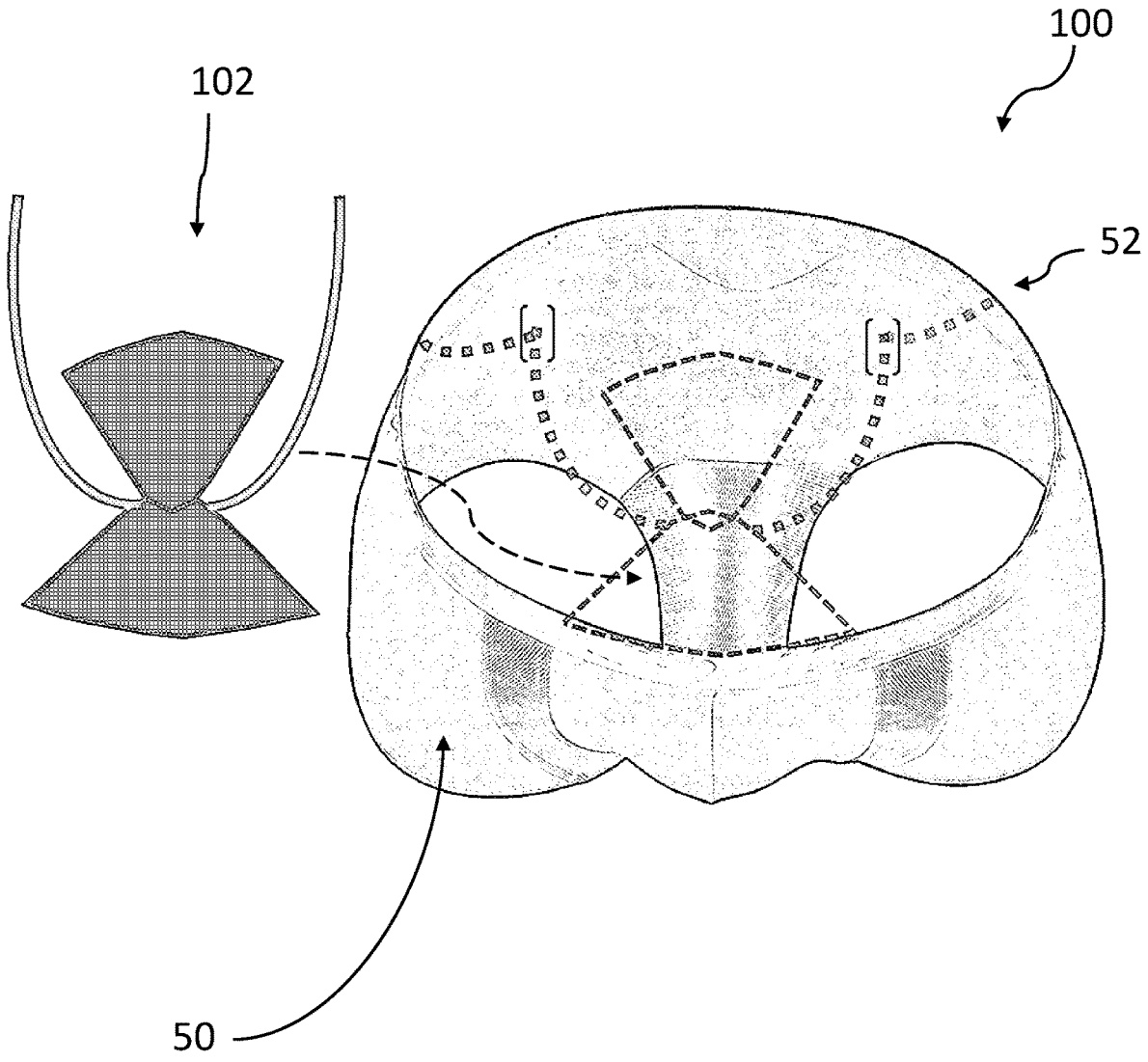
FIG. 11 is a top perspective view of another embodiment of a lower-body garment, similar to FIG. 10, in which the sling assembly is removable.

With reference to FIGS. 10 and 11, in another exemplary embodiment, a lower-body garment 100 includes a sling assembly 102, having an hourglass configuration. The sling assembly includes a cupped portion 106 and a connector assembly 104. The connector assembly is formed of a shaped strap (104*b*) and two auxiliary straps (104*a*, 104*c*), attaching the cupped portion 104*b* to the rear portion 52 of the garment body. The sling assembly 102 is only attached to the front portion 50 of the garment 100 and the rear portion 52 of the garment, above the groin region, such that the sling assembly is freely suspended therebetween. Moreover, the sling assembly is free of attachments to the groin region. As best seen in FIG. 11, in a similar embodiment to that of FIG. 10, the sling assembly 102 can be removably attached, as otherwise discussed herein.

Figure 12:
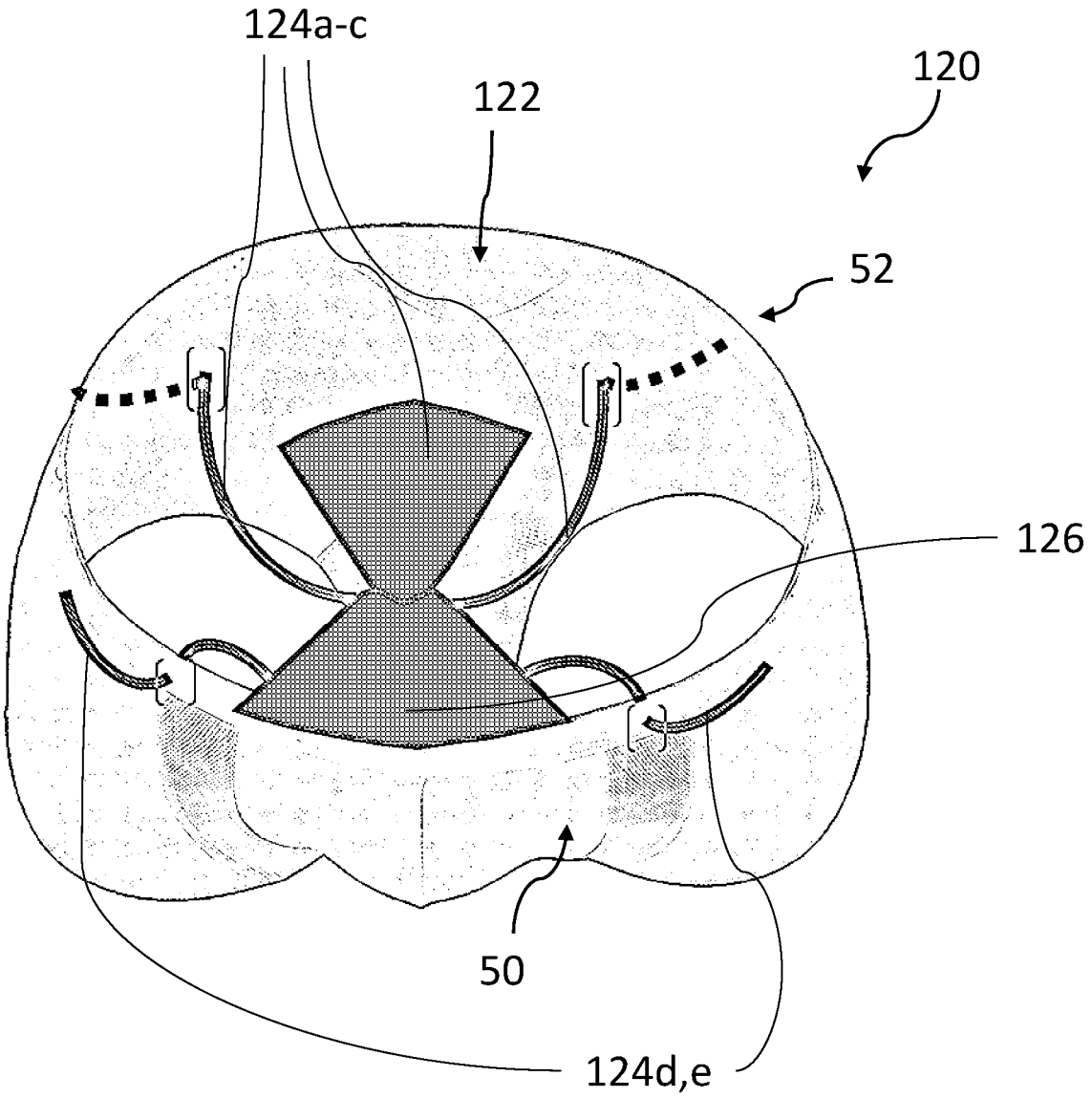
FIG. 12 is q top-perspective view of another embodiment of a lower-body garment in accordance with the invention, showing a sling assembly having an hourglass shape further having adjustable connector straps connected to the front and the rear portions of the garment body.
Figure 13:
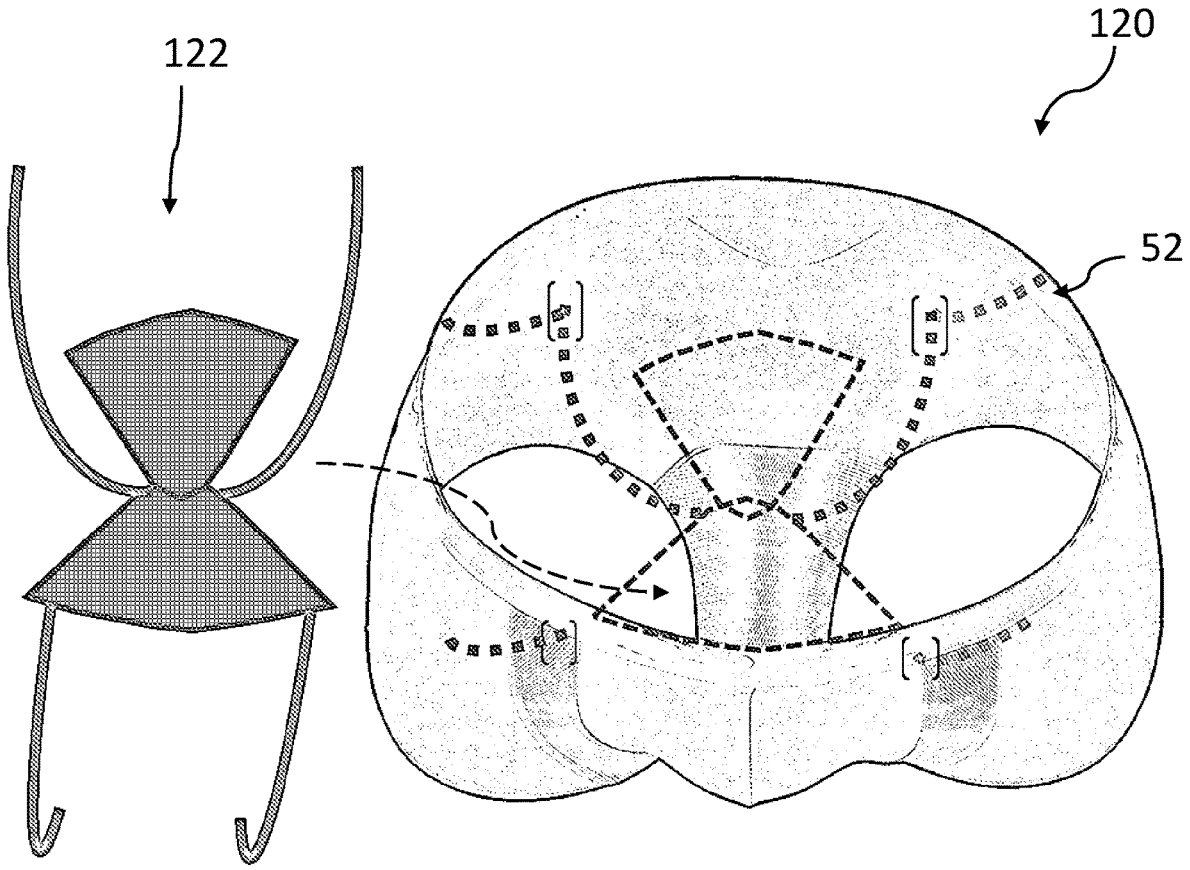
FIG. 13 is a top perspective view of another embodiment of a lower-body garment, similar to FIG. 12, in which the sling assembly is removable.

With reference to FIGS. 12 and 13, in another exemplary embodiment, a lower-body garment 120 includes a sling assembly 122, having an hourglass configuration. The sling assembly includes a cupped portion 126 and a connector assembly 124. The connector assembly is formed of a shaped strap (124*b*) and four auxiliary straps (124*a*, 124*c*, 124*d*, and 124*e*), attaching the hour-glass portion of the sling assembly 122 to the rear portion 52 of the garment body and to the front portion 50 of the garment body. The sling assembly is only attached to the front portion 50 and the rear portion 52, above the groin region, such that the sling assembly is freely suspended therebetween. Moreover, the sling assembly is free of attachments to the groin region. As best seen in FIG. 13, in a similar embodiment to that of FIG. 12, the sling assembly can be removably attached, as otherwise discussed herein.

As will be appreciated by those of reasonable skill in the art, there are numerous embodiments to this invention, and variations of elements, steps, and system components that may be used, all within the scope of this invention.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The present invention has been described above in terms of presently preferred embodiments so that an understanding of the present invention can be conveyed. However, there are other embodiments not specifically described herein for which the present invention is applicable. Therefore, the present invention should not be seen as limited to the forms shown, which is to be considered illustrative rather than restrictive.

What is claimed is:

1. A lower body garment having a sling assembly, comprising:

a waistband assembly configured to be disposed about a waist of a wearer, the waistband assembly having a front portion disposed above the genitalia of the wearer, when worn;

a garment body configured to be disposed about a trunk of the wearer, the garment body having an upper portion attached to the waistband assembly, a lower portion defining two openings for legs of the wearer, and a groin region disposed between the two openings; and a sling assembly having a cupped portion sized and positioned to cup male genitalia, when worn, the cupped portion having a lower end and an upper end, the upper end attached to the front portion of the waistband assembly and/or the upper portion of the garment body, the sling assembly further having a connector assembly having a first section and a second section spaced therefrom, the first section attached to the lower end of the cupped portion and the second section attached to the garment body such that the connector assembly extends into a groin region of the garment body, in which the sling assembly only having the upper end of the cupped portion attached to the waistband assembly and/or the upper portion of the garment body and to the connector assembly attached to the garment body.

2. The garment as defined in claim 1, wherein the upper end of the cupped portion is secured via an attachment that affixes the waistband assembly to the upper portion of the garment body.

3. The garment as defined in claim 1, wherein the connector assembly includes a first connector strap and a second connector strap, the first connector strap and the second connector strap each affixed to the lower end of the cupped portion.

4. The garment as defined in claim 1, wherein the connector assembly includes, a first connector strap having two connections, namely, a first connection attached to the lower end of the cupped portion, and a second connection attached to a back portion of the garment body, and a second connector strap having two connections, namely, a first connection attached to the lower end of the cupped portion, and a second connection attached to the back portion of the garment body.

5. The garment as defined in claim 1, wherein the sling assembly is free of attachments to the groin region.

6. The garment as defined in claim 1, wherein the connector assembly includes adjustable connector straps attaching the cupped portion to a rear portion of the garment body, in which the connector straps extend through apertures defined by the rear portion of the garment body, to enable the wearer to adjust the connector straps.

7. The garment as defined in claim 1, wherein the garment body is formed of multiple fabric panels, including a back panel in a back portion of the garment body, a right-side panel, a left-side panel, a front panel, and a gusset panel in the groin region of the garment body.

8. The garment as defined in claim 7, wherein the connector assembly includes, a first connector strap having two connections, namely, a first connection attached to the lower end of the cupped portion, and a second connection secured via an attachment that affixes the back panel to the right-side panel of the garment body, and a second connector strap having two connections, namely, a first connection attached to the lower end of the cupped portion, and second connection secured via the attachment that affixes the back panel to the left-side panel of the garment body.

9. The garment as defined in claim 7, wherein the upper end of the cupped portion is secured via an attachment that affixes the waistband assembly to the front panel of the garment body.

10. A lower body garment having a sling assembly, comprising:

a waistband assembly configured to be disposed about a waist of a wearer, the waistband assembly having a front portion disposed above genitalia of the wearer, when worn;

a garment body configured to be disposed about a trunk of the wearer, the garment body having an upper portion attached to the waistband assembly, a lower portion defining two opening for legs of the wearer, and a groin region disposed between the two openings; and a sling assembly having a cupped portion sized and positioned to cup male genitalia, when worn, the cupped portion having a lower end and an upper end attached to the front portion of the waistband assembly and/or the upper portion of the garment body, the sling assembly further having a connector assembly having a first section and a second section spaced therefrom, the first section attached to the lower end of the cupped portion and the second section attached to the garment body such that the connector assembly extends through a groin region of the garment body, such that the sling assembly only has the upper end of the cupped portion and the connector assembly attached the waistband and the garment body.

11. The garment as defined in claim 10, wherein the sling assembly is free of attachments to the groin region.

12. The garment as defined in claim 10, wherein the connector assembly includes adjustable connector straps attaching the cupped portion to a rear portion of the garment, in which the connector straps extend through apertures defined by the rear portion of the garment body, to enable the wearer to adjust the straps.

13. The garment as defined in claim 10, wherein the garment body is formed of multiple fabric panels, including a back panel in a back portion of the garment body, a right-side panel, a left-side panel, a front panel, and a gusset panel in the groin region of the garment body.

14. The garment as defined in claim 13, wherein the connector assembly includes, a first connector strap having two connections, namely, a first connection attached to the lower end of the cupped portion, and a second connection secured via the an attachment that affixes the back panel to the right-side panel of the garment body, and a second connector strap having two connections, namely, a first connection attached to the lower end of the cupped portion, and second connection secured via the attachment that affixes the back panel to the left-side panel of the garment body.

15. The garment as defined in claim 10, wherein the upper end of the cupped portion is secured via the attachment that affixes the waistband assembly to the upper portion of the garment body.

* * * * *